US005409061A

United States Patent [19]

Bullick

[11] Patent Number: 5,409,061

[45] **Date of Patent: * Apr. 25, 1995**

[54] GRAVEL PACKING SYSTEM WITH FRACTURING AND DIVERSION OF FLUID

[76] Inventor: Robert L. Bullick, 130 St. Ann St., Belle Chasse, La. 70037

[ * ] Notice: The portion of the term of this patent subsequent to Jul. 19, 2011 has been disclaimed.

[21] Appl. No.: 238,242

[22] Filed: May 4, 1994

Related U.S. Application Data

[63] Continuation-in-part of Ser. No. 994,944, Dec. 22, 1992, Pat. No. 5,330,003.

[51] Int. Cl.[6] ..... E21B 43/04; E21B 43/08

[52] U.S. Cl. ..... 166/278; 166/51; 166/205

[58] Field of Search ..... 166/278, 51, 74, 157, 166/158, 205, 227, 236, 296

[56] References Cited

U.S. PATENT DOCUMENTS

| | | | |
|---|---|---|---|
| 1,305,914 | 6/1919 | Mack | 166/158 |
| 1,975,162 | 10/1934 | Layne . | |
| 2,401,035 | 5/1946 | Akeyson et al. | 166/205 |
| 2,913,051 | 11/1959 | Lister | 166/296 X |
| 3,120,268 | 2/1964 | Caldwell . | |
| 3,216,497 | 11/1965 | Howard et al. | 166/296 X |
| 3,333,635 | 8/1967 | Crawford . | |
| 4,018,283 | 4/1977 | Watkins | 166/296 X |
| 4,046,198 | 9/1977 | Greusbeck et al. . | |
| 4,202,411 | 5/1980 | Sharp et al. . | |
| 4,498,543 | 2/1985 | Pye . | |
| 5,040,601 | 8/1991 | Karlsson . | |
| 5,165,476 | 11/1992 | Jones . | |
| 5,330,603 | 7/1994 | Bullick | 166/278 |

OTHER PUBLICATIONS

Dowell Schlumberger brochure on "STIMPAC" W. L. Penberthy Jr. and C. M. Shaughnessy, *Sand Control,* pp. 45–57, 1992.

*Primary Examiner*—William P. Neuder

*Attorney, Agent, or Firm*—Pravel, Hewitt, Kimball & Krieger

[57] ABSTRACT

Method and apparatus for gravel packing wells are provided. Selected intervals of wells may be fractured before gravel packing. The open area of a screen device and the number of perforations exposed to slurry are increased as gravel is pumped into a well during gravel packing operations. Means for creating back-pressure on perforations not yet covered with gravel is provided to decrease flow of particles into the casing during gravel packing operations. Gravel pack screen assemblies by which flow area can be incrementally increased are disclosed, along with apparatus for providing desired back-pressure on open perforations.

20 Claims, 6 Drawing Sheets

GRAVEL PACKING SYSTEM WITH FRACTURING AND DIVERSION OF FLUID

This is continuation-in-part of application Ser. No. 07/994,944, filed Dec. 22, 1992.

BACKGROUND OF THE INVENTION

1. Field of the Invention

This invention pertains to method and apparatus for completion of wells by gravel packing with or without hydraulic fracturing conditions. More specifically, improved gravel placement outside the gravel-packing screen is provided.

2. Description of Related Art

Mechanical exclusion is the most common method of preventing sand or other particles from entering a well as fluids are produced from or injected into the well. Various devices, called screens or slotted liners, having openings small enough to exclude particles when fluid flows into the well through the devices have been used. The placement of particles larger than formation particles between the screen or slotted liner and the formation is called gravel packing. The "gravel" size, normally from about 0.01 inch to several times this size, is selected to prevent movement of grains of formation material through the gravel pack. The size of openings in the screen is selected to prevent movement of gravel through the screen. The gravel is placed by pumping a slurry into the well after the screen is in place.

Gravel packing of wells began in the water well industry; it has been widely adopted in the petroleum industry. The pack may be placed in open hole or inside perforated casing. There are advantages and disadvantages of each type completion, but the cased-hole gravel pack is more common in oil and gas wells.

Placement of the gravel to form an effective filter in the well that has highest conductivity for fluids but prevents solid entry is a critical step in the gravel-packing operation. It is also important that no voids exist in the gravel pack, because formation solids may then flow through the screen and cause "sand-up" of the well. It is especially important in cased-hole gravel packs that gravel be placed between and inside the perforation tunnels and the screen. Lack of gravel to protect the screen from the high velocity fluids entering through perforations can lead to early failure of the gravel pack from erosion of the screen opposite a perforation.

The fluid used to form the gravel slurry to be pumped into the well may be water-based, oil-based, an emulsion or a foam. Polymers may be used to increase the viscosity of the water or oil. If viscous fluid is used, the gravel is pumped at high concentration (in the range of 10 pounds per gallon) in the slurry, in a process called slurry packing. If low viscosity fluid is used, gravel concentrations in the range of 1 pound per gallon of the gravel are normally pumped and the fluid is circulated into and out of the well, the gravel particles being filtered out and formed into a pack as fluid passes through the screen in the well. Fluid may also flow out the perforations during the packing process.

Different techniques are available for flowing the gravel into a well. In the reverse circulation technique, the slurry is pumped down the annulus outside tubing in the well, gravel is filtered out on the screen, and return fluid flows back to surface through the tubing. More commonly, the "cross-over" method is used, in which the slurry is pumped down the well inside tubing, under conditions of higher flow velocity to prevent bridging of the particles, until the slurry is near the screen. A "cross-over" tool then directs flow from inside the tubing to the annulus outside the screen. Also, a "wash pipe" may be connected to the cross-over tool, which is a pipe inside the screen which transports the fluid with gravel removed. The return fluid then flows up the annulus outside the tubing. The cross-over tool may be mounted inside a packer which seals the annulus outside the tool, called a "cross-over packer."

In vertical wells, gravel-packing success is greater than 90 per cent. However, many wells are drilled which are deviated from vertical-offshore from platforms and in the arctic from pads, for example. Angles of deviation where the wellbores intersect hydrocarbon reservoirs are often above 45 degrees, and may be as high as 90 degrees or more. In addition to the deviated wells, more recently there has been rapid growth in the number of horizontal wells, in which holes are drilled at near 90 degrees angle for substantial distances in hydrocarbon reservoirs. Horizontal wells and deviated wells are also drilled for remediation of contamination of ground water and for other environmental applications. The success of gravel packing in these deviated and horizontal wells has been significantly less than in vertical wells. The lower success is generally ascribed to the difficulty of obtaining uniform and complete gravel placement in the annulus outside the screen. Gravel tends to form mounds or dunes outside the screen during placement. Settling of incompletely packed gravel around the screen also leaves parts of the annulus void of gravel. The state-of-the-art of gravel packing in general, and gravel packing in deviated wells in particular, is reviewed in the monograph *Sand Control*, Society of Petroleum Engineers, Richardson, Tex., 1992. As pointed out in Chap. 8 of this reference, at angles above about 60 degrees, transport and settling of gravel around screens requires special considerations. More recently, the art is reviewed in the article "Gravel Placement in Wells," *J. Pet. Tech.*, Jul., 1993, pp. 612 ff.

One of the proposed solutions to the problem of gravel packing of highly deviated wells was to place cups on the wash pipe. The cups were proposed to decrease the tendency for sand to form dunes outside the screen. However, even with the cups, fluid can still enter or leave the annulus between the cups on the wash pipe. U.S. Pat. No. 4,046,198 discloses use of wash pipe (or "stinger") of increased diameter so as to increase flow resistance in the annulus between the wash pipe and the screen and minimize formation of dunes outside the screen. While this latter technique can increase placement efficiency of gravel, as shown in the monograph *Sand Control* on page 49, at high well deviation angles placement efficiency is still below 100 per cent. This failure to pack the annulus outside the screen with gravel can lead to gravel settling to the bottom of the annulus and gravel pack failure in deviated wells.

U.S. Pat. No. 5,165,476 proposes method and apparatus for increasing the efficiency of gravel placement in wells by restricting flow into the upper part of the screen during circulation of gravel slurry into the well. The restriction is then removed after gravel has been placed. The area of screen open for flow during gravel placement is fixed.

There is a long-felt need for method and apparatus to increase the efficiency of gravel placement outside screens devices in wells, particularly in wells where the screen device is at a high angle from vertical. The method should allow formation of a uniform gravel pack around the screen, the gravel filling the annulus outside the screen over the entire length of the screen. Optionally, conditions of pressure and flow should allow for hydraulic fracturing of the well before gravel packing.

SUMMARY OF THE INVENTION

A method of gravel packing a well is disclosed in which a screen surrounded by a slidable sleeve is placed in the well and the screen is anchored to the wall of the wellbore, the slidable sleeve is released to move, flow of a gravel slurry is directed through a conduit to a region below movable seals on the sleeve, and the area of screen exposed to gravel slurry is increased by upward movement of the sleeve as the slurry is pumped down the well. In one embodiment, the conduit is between concentric cylinders which together form the sleeve. In other embodiments, one or more conduits between the slidable sleeve and the screen and attached to the exterior or interior of the slidable sleeve are used. The slidable sleeve may itself be formed of a screen. In another embodiment, the slidable sleeve is formed of concentric cylinders and a port through the sleeve is placed in proximity to the seals at the distal end of the sleeve.

In one embodiment, a sleeve such as a hollow sleeve, two different size OD sleeves one inside the other, or several conduits attached to the inside or outside of the sleeve concentrically placed over the screen is removably fixed to the screen so as to cover the screen, the sleeve is freed to move axially after the screen is anchored to the wall of the wellbore and the sleeve is axially moved to expose increasing area of the screen and additional perforations to be packed as slurry is pumped down the sleeve and outside the sleeve and around the screen. The sleeve is then removed from the well.

In another embodiment, method and apparatus for gravel packing a well is provided comprising a sleeve outside the screen and a large OD wash pipe inside the screen, the sleeve and large OD wash pipe being slidable together along the common axis of the screen and sleeve so as to expose increasing area of the screen and perforations. Gravel packing fluid with gravel pack sand is pumped to the distal end of the sleeve between the sleeve and the screen, the large OD wash pipe with swab cup or flow deflectors preventing gravel accumulation on the screen and increased risk of sticking the sleeve. Fluid returns to the surface via washpipe, crossover and by-pass or is squeezed into the formation if the by-pass is plugged. A by-pass and restriction to flow outside the sleeve is located above the perforations to be gravel packed to create a back pressure against the formation while gravel packing. The back pressure applied prevents formation sand or gravel pack sand from migrating behind the casing into the wellbore during gravel packing. Before gravel packing, additional gravel may be placed in a hydraulic fracture created in the formation surrounding the well by pumping fluid at a pressure above the fracture pressure gradient of the formation.

In another embodiment, fluid with gravel pack sand is pumped down the workstring and through the wash pipe to exit through a ported sliding sleeve located in the bottom of the screen section. The gravel pack sand packs off between the screen, casing, seal and swab cup located on the sleeve. A ported sub allows fluid to return to the annulus above the swab cup after depositing gravel below the swab cup and causes pressure to be applied to the formation above. The wash pipe is made up of sections of slidable small OD wash pipe and fixed large OD wash pipe. The sleeve and small OD wash pipe is slidable along the common axis of the screen and sleeve so as to expose increasing area of the screen. The small OD section of wash pipe moves with the sliding sleeve and the large OD section of wash pipe remains fixed during gravel packing.

Apparatus for gravel packing a well is provided, comprising a screen having a sleeve enclosing at least a part of the screen, the sleeve being slidable along the common axis of the screen and sleeve so as to expose increasing area of the screen and perforations, and a restriction to flow outside the sleeve.

DESCRIPTION OF PREFERRED EMBODIMENTS

Figure 1:
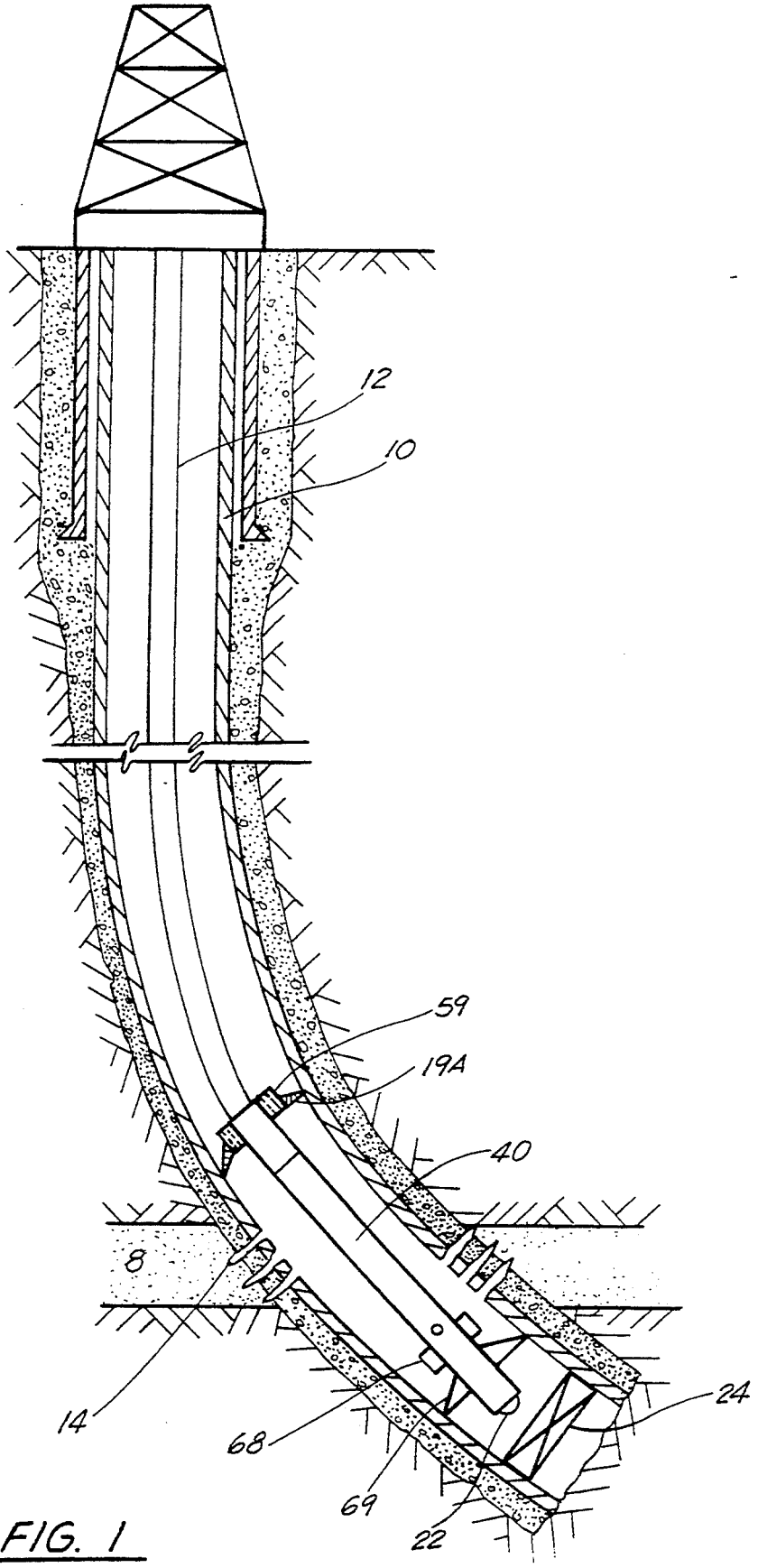
FIG. 1 is a schematic drawing of placement of apparatus in a deviated well.

Referring to FIG. 1, casing 10 has been placed in a deviated well drilled through formation 8. All casings in the well have been cemented using normal procedures. Casing 10 has perforations 14 which have not been prepacked with gravel. Anchor packer 24 has been placed in the well and set by electric wire line, work string or by coiled tubing. Screen assembly 40 has been run into the well on work string 12. Swab cups 19 and 19A point downward so as to contain fluid from below. The swab cups serve to confine fluid in the annulus outside the gravel pack equipment while pumping. Swab cup 19A may be attached to by-pass 59 or may be separately attached to assembly 40 or in proximity to assembly 40. Centralizer 68 separates assembly 40 from the wall of the casing, providing for packing gravel completely around the screen. The bottom of screen assembly 40 has latch ring 22. The assembly is lowered into the well, latch ring 22 contacts anchor packer 24 and locks the screen (not shown) in screen assembly 40 to anchor packer 24. The assembly shown in FIG. 1 differs from the assembly of co-pending U.S. patent application Ser. No. 07/994,944 in that by-pass 59 and swab cup 19A at the upper end of assembly 40 have been added. The above-referenced patent application is incorporated by reference herein for all purposes.

Figure 2A:
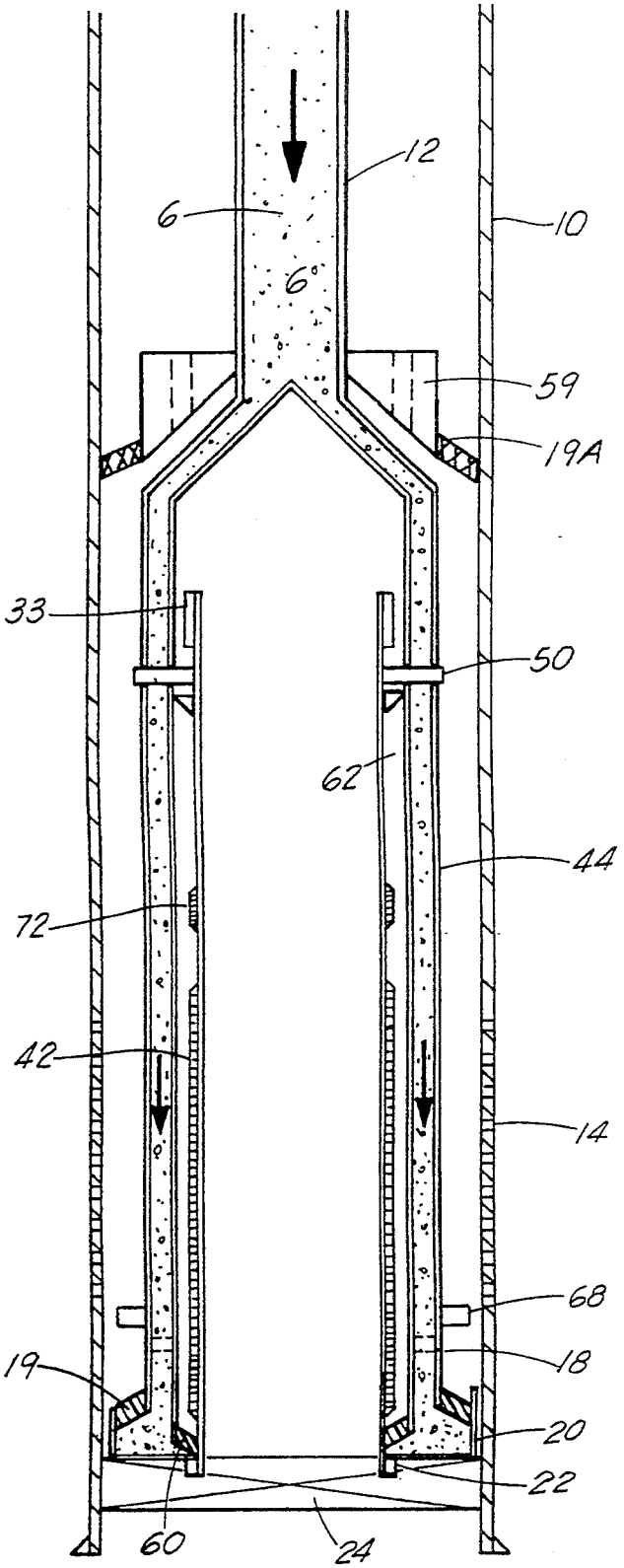
FIG. 2A, B and C are schematic drawings of apparatus for increasing open screen area and exposing additional perforations by moving an enclosing slidable sleeve that is formed from concentric pipes.
Figure 2B:
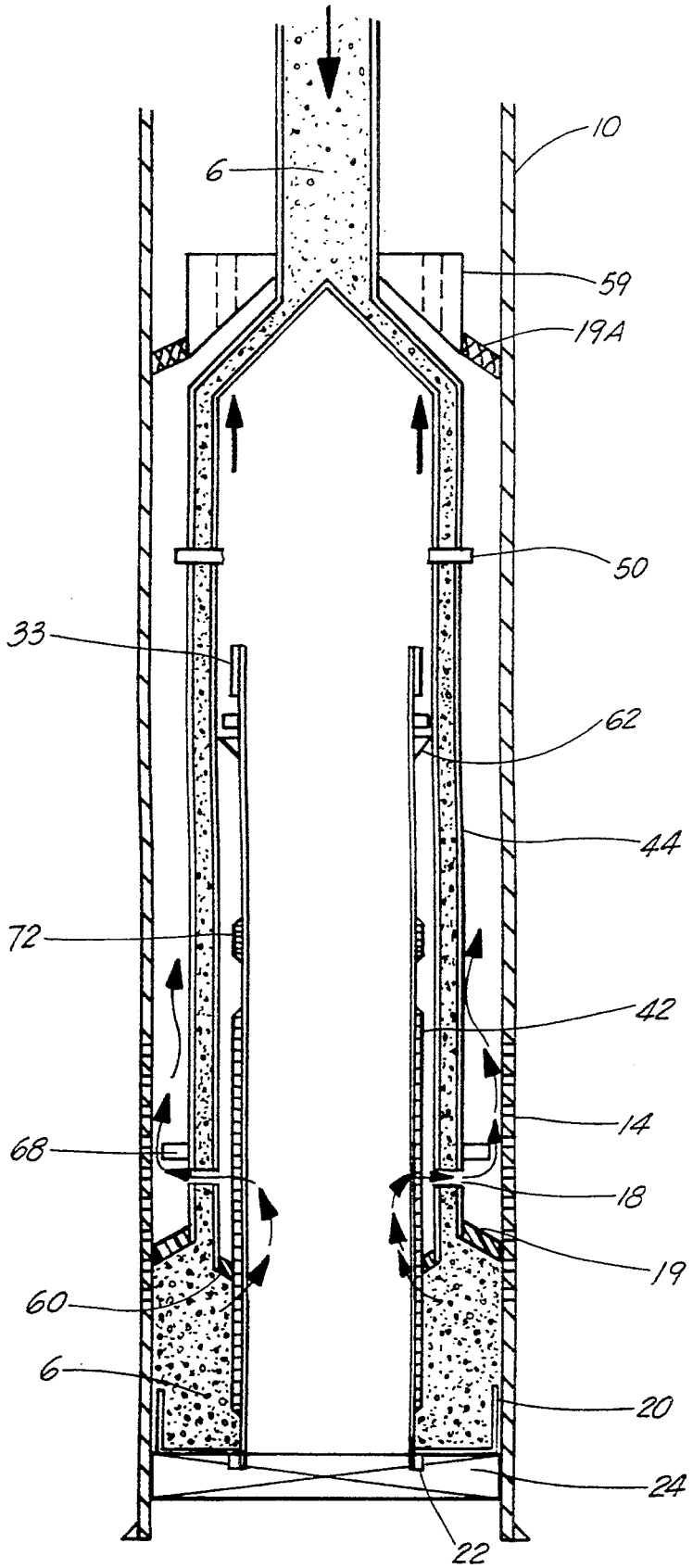
Figure 2C:
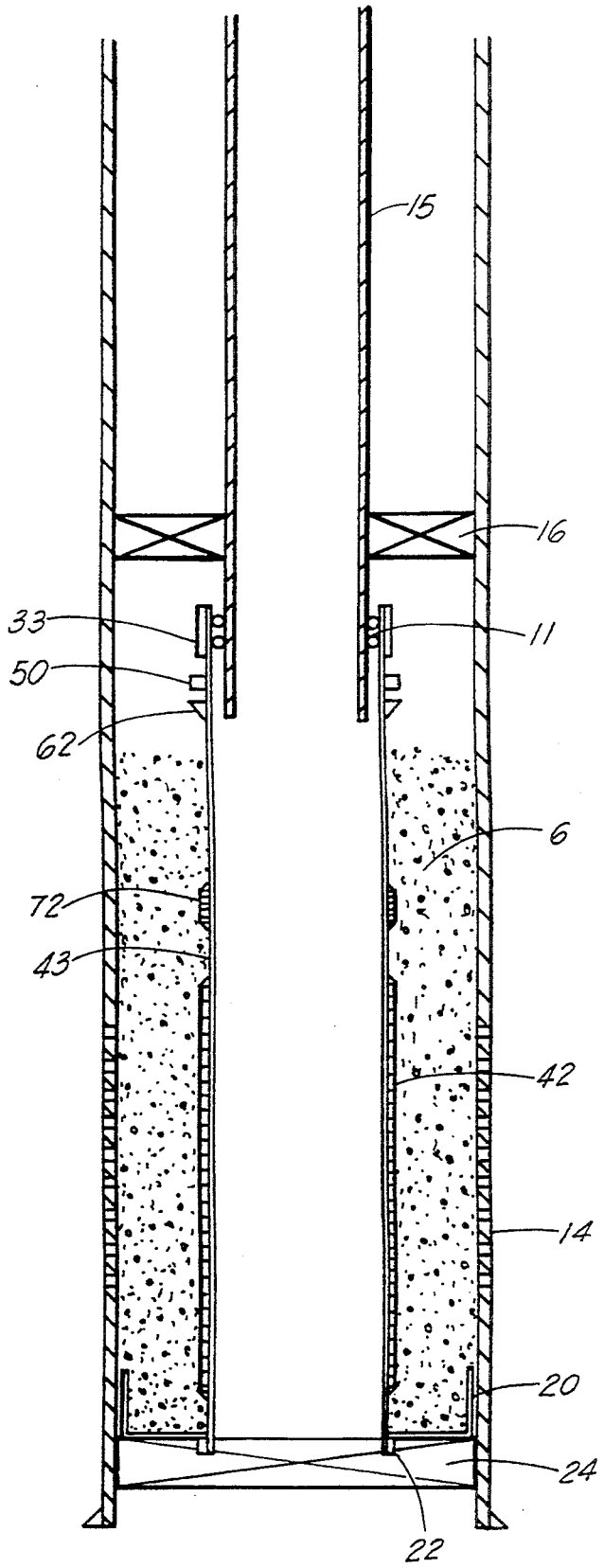

FIGS. 2A, 2B and 2C show details of the installation of a preferred embodiment of screen assembly 40. Although the assembly is shown in a vertical direction, it should be understood that it can be placed in a well at any angle, including horizontal or even at an angle above horizontal.

FIG. 2A illustrates the assembly after it has been locked to anchor packer 24 using lock ring 22. Work string 12 is joined to sleeve 44 through a sub having by-pass 59 and swab cup 19A attached thereto. The sub having swab cup 19A and by-pass 59 is joined at the top of a sub having pin 50, the latter sub being adapted to join with slidable sleeve 44. Although not shown, by-pass. 59 can be a shear pinned sliding sleeve that can be closed by pumping a ball that would shear the pins, close the by-pass and allow pumping through the sub containing by-pass 59, as shown. This type by-pass would allow placing the assembly in the well without swab cup 19A causing surge pressures below the swab cup.

The purpose of by-pass 59 and swab cup 19A, to be placed in the well above the highest perforation to be gravel packed, is to apply pressure against the formation while gravel packing. This is done to prevent flow of formation sand or gravel into the annular space between sleeve 44 and casing 10 or open hole. This flow could result from gravel pack sand and fluid being pumped into perforations below swab cup 19, going outside casing 10 and reentering the casing above swab cup 19.

In addition to the back-pressure provided by by-pass 59 and swab cup 19A to prevent particles entering the casing above swab cup 19, provision is made to remove any particles that may enter the wellbore above swab cup 19. Fluid passing through port 18 can transport particles out of the well through by-pass 59 to the surface. Should by-pass 59 become plugged, fluid pressure may be applied to squeeze the fluid into the formation and no fluid returns are taken at the surface. Swab cup 19A and by-pass 59 can be used similarly in open hole wells. By-pass 59 can also be intentionally plugged to squeeze all fluid into the formation, or the amount of returns can be controlled by the size of the orifice in by-pass 59, the size being selected to maintain pressure against the formation during gravel packing while taking restricted returns to the surface. The size of orifice in by-pass 59 may be controlled from the surface by techniques known in industry.

Attached to the sub containing pin 50 are a selected number of sleeve segments which go to form sleeve 44. Near the bottom of sleeve 44 is a sub having port 18. A safety/shear sleeve joint (not shown) may be placed just above the sub having port 18 to provide a means to release should the slidable equipment get stuck. Port 18 should be located in proximity to the top of the last cup 19 so as to allow washing out of any particles that may enter the wellbore above swab cup 19 while gravel packing or fracturing below swab cup 19. The sub having port 18 is connected to a sealing sub having seal 60 and swab cup 19. Swab cup 19 and seal 60 are positioned so as to confine gravel pack sand and fluid below the seals. Swab cup 19 may consist of multiple single swab cups or packers designed for forming sliding seals. Such packers are well-known in the art.

As screen assembly 40 is placed in the well, swab cup 19 causes wellbore fluid to flow through the assembly. The swab cup, or multiple cups if preferred, may be protected from damage and flow though the assembly may be eliminated by placing swab cup cover 20 on the swab cup before the equipment is placed in a well. This cover may be attached just above lock ring 22. The cover remains in the well. Seal 60 at the end of sleeve 44 preferably does not completely cover screen 42 before pin 50 is sheared, such that circulation of fluid through that screen is possible before the sleeve is released to move upward. Movement of sleeve 44 to expose increasing area of screen 42 is initiated by a pull through work string 12 to shear pin 50.

Referring to FIG. 2B, fluid containing gravel particles 6 is being pumped down work string 12 and through sleeve 44 into the annulus below sleeve 44, swab cup 19 and seal 60. A partial gravel pack formed near the distal end of the screen is covering part of screen 42. Seal 60 on sleeve 44 slides over screen 42 as sleeve 44 is moved to expose greater area of the screen and swab cup 19 slides over casing 10 exposing additional perforations. Bottom-hole pumping pressure may be increased to above the fracture pressure gradient of surrounding formation to initiate a hydraulic fracture at any point in the position of the sleeve after the first perforation is exposed to wellbore pressures. A desired amount of gravel in a slurry may be pumped outside the perforations using known fracturing techniques. Gravel packing operations may then proceed to obtain a packing of gravel in the wellbore and outside the screen.

Seal 60 may be of construction similar to a swab cup or may be a deformable material in a variety of shapes designed to slide along and in contact with screen 42. Seal 60 is designed to prevent gravel from entering between sleeve 44 and screen 42.

Centralizer 68 is used to ensure a more uniform distribution of gravel around the screen. Centralizer 68 may also be of a design to direct flow toward perforations above port 18, so as to clean perforations before gravel packing in highly deviated or horizontal wells. Such centralizer-flow directors are known in the art. Centralizer 68 may also be of conventional solid or special solid centralizer construction.

Sleeve 44 may also have secondary seals (not shown) to back-up seal 60 as it slides over uneven diameters of the screen. Primary and secondary seals located on sleeve 44 are preferably spaced so that at all times during the gravel-packing operation a seal is in contact with the blank pipe or screen within the sleeve.

Referring to FIG. 2C, the gravel pack is in place and production tubing 15 has been placed in the well. Polish bore 33, joined to the screen, is used to seal the tubing to the screen. Production packer 16 with seal assembly 11 is placed so as to seal in polish bore 33. Production packer 16 is then set and the production tubing is attached to the wellhead at the surface. The well is then ready for use.

To run screen assembly 40 in a well, the preferred procedure is as follows. Screen joint 42 is screwed into mechanical or hydraulic anchoring packer 24 if packer 24 is to be run with the screen assembly. Alternatively, packer 24 can be run into the well and set by electric wire line or work string prior to running the screen assembly 40 into the well. This later procedure is shown in FIG. 1. When this alternative is followed, snap latch 22 with swab cup cover 20 is attached to the pin end of screen 42. In open hole completions, an inflatable packer is preferably used as anchor packer 24.

The next step is to pick up sleeve section 44 (FIG. 2B) and seal 60 and swab cup 19. Alternatively, a pressure/-velocity set packer element can be used in place of swab cup 19. Such packers are well known in the art. With this type packer, the packer element is squeezed out to touch the casing wall and to provide a seal against the casing while pumping gravel pack fluid. Use of this type packer would allow fluid to flow past the OD of sliding sleeve 44 while going in the well with assembly 40.

Such packer elements can also be expanded by trapped pressure or by a weight-set sealing element.

Sleeve 44 is placed over screen joint 42 and the hollow sub having port 18 is joined to the top of the sub having seals 19 and 60. A sub having port 18 allows the gravel pack screen and the perforations above swab cups 19 to be washed by gravel pack fluid returning to the surface after the gravel is filtered out on the screen if by-pass 59 is used. The fluid without gravel crosses over at 18 and enters the casing annulus. By-pass 59 and swab cup 19A are located above the top perforation and the opening through by-pass 59 is sized to create back pressure against the formation. If by-pass 59 is plugged, all fluid is squeezed into the formation. Centralizer 68 directs the flow toward the perforations above swab cup 19 to enhance cleaning of the perforations and provide uniform amounts of gravel around the screen. Metal covering 20 is attached as swab cup(s) 19 are squeezed to an ID less than the ID of the casing.

In open hole completions where the hole is washed out and sealing of swab cup 19 or an inflatable packer is difficult to obtain, it will be necessary to establish a seal (swab cup 19 or equivalent) in the last string of casing run in the well or in gauge open hole. Gravel pack fluid would be directed towards the distal end of the screen and fluid without gravel would return to the surface via a wash pipe added for this purpose and through a cross over above swab cup 19 located inside the last casing string run or gauge open hole.

Next, alternating sections of sleeve 44 are placed over alternating sections of screen 42 and blank pipe 43. A pre-determined number of joints of blank pipe followed by upper tell tail joint 72 are attached to the top of screen 42. Upper tell-tail 72 preferably would have a two foot or greater screen section. The tell-tail joint should be above the blank pipe to allow filling of the annulus with gravel. A sub containing shear pin groves is joined to the top of upper tale tail joint 72 followed by polished bore receptacle 33. Seal 62, part of the sub containing shear pin groves, seals between the sleeve and stationary blank pipe to prevent particles from sticking sleeve 44 while gravel is being placed outside the screen.

The sub containing shear pin 50 (a hydraulic release could be used in place of a shear pin) is screwed into the last joint of sleeve 44. When pin 50 is inserted, sleeve 44 and screen 42 are removably fixed to prevent their relative longitudinal or axial movement until pin 50 is sheared. Wash pipe is installed inside the screen if required at this point. The wash pipe is attached to a sub which is adapted to allow workstring 12 to be joined to assembly 40.

Work string 12 may be conventional tubing or coiled tubing. Preferably, a TIW valve is run in a conventional work string. The valve will be closed when laying down joints or stands of work string as screen assembly 40 is moved upward in the well. It will be necessary to lay down joints if the interval to be gravel packed is longer than a stand that the rig is capable of pulling.

Screen assembly 40 (FIG. 1) is placed in the well at the desired depth. If anchoring packer 24 is attached to assembly 40 as it is placed in the well, the packer is then set. If the packer has already been set in the well, assembly 40 is latched into the anchoring packer with latch 22.

As an alternative which may be particularly attractive in horizontal or high-angle wells, gravel pack assembly 40 may be made pressure-tight with gas inside and the entire gravel pack assembly may be floated into a well. A valve may open the assembly after it is in place as slip ring 22 is activated. This procedure can be used to place the gravel pack assembly through long horizontal sections in a well.

After the screen is anchored, tension is applied through work string 12 to shear pin 50. After the pin is sheared, by-pass 59, swab cup 19A, sleeve 44, crossover 18 and attached equipment are free to be moved by string 12. The screen and attached equipment are fixed in the well by anchor packer 24. The movable equipment may be moved upward to the point that seal 60 is clear of a segment of screen 42 before circulation begins. Fluid with gravel travels down sleeve 44, exits below seal 60 and swab cup 19 and enters the casing annulus. Fluid without gravel then flows through the screen that is exposed below seal 60 and upward to port 18, through the port and into the annulus between swab cup 19 and swab cup 19A. If by-pass 59 is open, the fluid then returns to the surface. An advantage of this flow path for fluid is that the screen is cleaned just before gravel is placed over the screen by the fluid returning to the annulus. By-pass 59 can be plugged by using plug 59A to close the orifice if squeeze packing is desired. If fracturing of gravel into the surrounding formation is desired, fluid returns at the surface can be closed or plug 59A can be used to close the orifice in by-pass 59, or both steps can be used to increase pumping pressure on the formation to above fracturing pressure.

At the surface, conventional gravel packing or fracturing equipment is used (not shown). Gravel is mixed, preferably at concentrations between about 1 and 2.5 pounds per gallon, and pumped at a rate of about 2.5 to 3.5 barrels per minute. When pump pressure begins to increase, indicating that the annulus surrounding screen area exposed to the gravel slurry is packed, the movable apparatus is moved upward, while continuing to pump gravel slurry. Fracturing pressures and rates are selected for each well using known techniques.

The amount of gravel added to the fluid is preferably calculated and compared with the volume of annulus to be filled up to various locations on the screen by gravel packing. Each time pump pressure increases after a known amount of gravel has been pumped, the sleeve is pulled up an additional distance exposing additional screen and perforations. Alternatively, sleeve 44 can be moved continuously while slurry is being pumped. Pump pressure is monitored closely and, preferably, measured gravel volumes pumped are compared with the distance that would be packed in the annulus and to the distance that sleeve 44 has been moved longitudinally or axially along the screen.

Work string 12 joints are laid down at the surface as each joint or stand pulls above the rotary until the annulus around the screen is completely packed. When the annulus is packed, there will be a sharp increase in pump pressure. A TIW valve is preferably installed in the open position in the work string at every point where a joint or stand will be laid down. Sufficient joints or stands of work string are pulled and laid down until port 18 is even with the upper tell tale screen 72. Pumping of gravel continues until gravel covers blank pipe 43 to form a gravel reserve.

In FIG. 2C, gravel packing is complete and sleeve 44 has been pulled from the well. Production tubing 15 having packer 16 attached and a seal assembly 11 which will seal in the polished bore 33 is then run into the well using conventional techniques.

Figure 3:
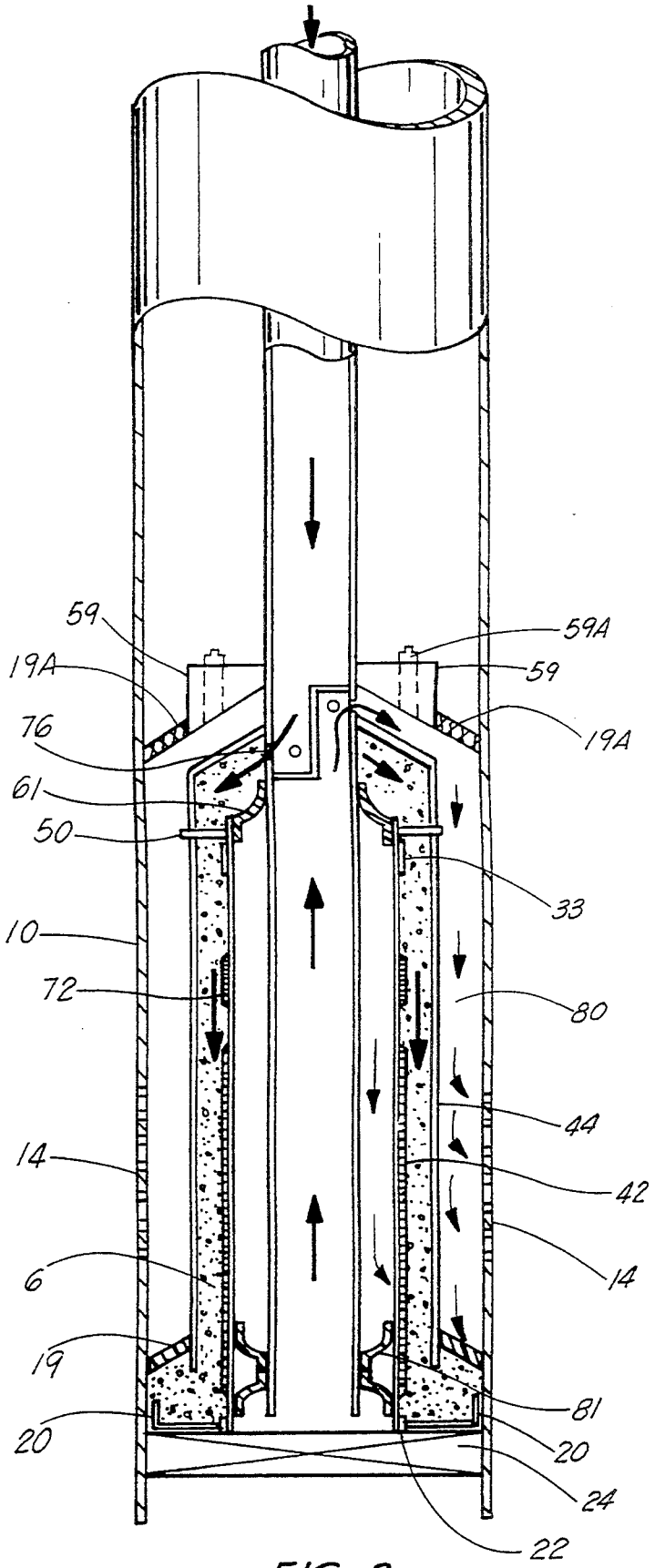
FIG. 3 is a schematic drawing of apparatus for increasing open screen area and exposing additional perforations by moving an enclosing slidable sleeve and a wash pipe inside the screen, the wash pipe having flow deflectors.

In another embodiment, shown in FIG. 3, sleeve 44 is outside the screen and large OD wash pipe 80, having diverter cups 81, is inside screen 42. Gravel pack fluid with gravel is pumped down work string 12. The fluid with gravel passes through ports 76 and continues to the distal end of sleeve 44 between sleeve 44 and screen 42. Flow which may occur between wash pipe 80 and screen 42 is diverted back outside the screen by diverter cups 81. Seal 61 is pinned to the top of the polish bore 33 to seal around washpipe 80 and prevent gravel pack sand from getting inside screen 42 during gravel packing operations. Seal 61 is removed when wash pipe 80 is pulled from the well after gravel packing. Fluid and gravel pack sand below swab cup 19 is continuously squeezed into perforations 14 below swab cup 19 and no returns are taken at the surface. The orifice in by-pass 59 is plugged by plug 59A to trap pump pressure below swab cup 19A. This trapped pressure results from fluid without gravel that travels up the wash pipe and exits below by-pass 59 and swab cup 19A. With the orifice in by-pass 59 plugged, pressure is applied to the formation through perforations 14, thereby preventing movement of particles from the formation behind the casing.

Batches of gravel pack sand can be preceded or followed by acid to stimulate the perforations while gravel packing. Gravel packing can also be performed with fluids which have a density lower than that required to balance formation pressure. Wash pipe 80 decreases the flow of gravel pack fluid through the screen to reduce the possibility of gravel bridging out on the screen and sticking sleeve 44 while gravel packing. Flow deflectors 81, if employed, aid further in directing flow outside the screen towards the distal end of the sleeve.

Alternatively, if gravel pack fluid is not squeezed into the formation, a crossover port may be placed just below by-pass 59 and swab cup 19A. When the port is open, fluid without gravel returns to the surface via wash pipe 46, the cross over port and by-pass 59. This alternative allows for circulating or squeezing during gravel packing operations. Squeezing or fracturing is obtained by shutting off fluid returns at the surface or by plugging by-pass 59.

Alternatively, in an open hole completion where swab cup 19 cannot form a seal against the formation due to hole wash out or some other irregularity in the wellbore, clean fluid with no gravel can be pumped down the casing annulus from the surface to apply squeeze pressure to force the fluid and gravel exiting from the sleeve to move toward the distal end of the exposed screen.

Hydraulic fracturing of the formation can be accomplished with any of the embodiments discussed above and gravel particles may be placed into the fracture formed below seal 19 or 19A. In this procedure, fluid is injected above fracturing pressure to form a fracture and particles are then added to the fluid with continued injection. After fracturing a well, gravel packing of the well then may proceed. Each interval below the distal end of the sleeve may first be fractured and then gravel packed.

Figure 4:
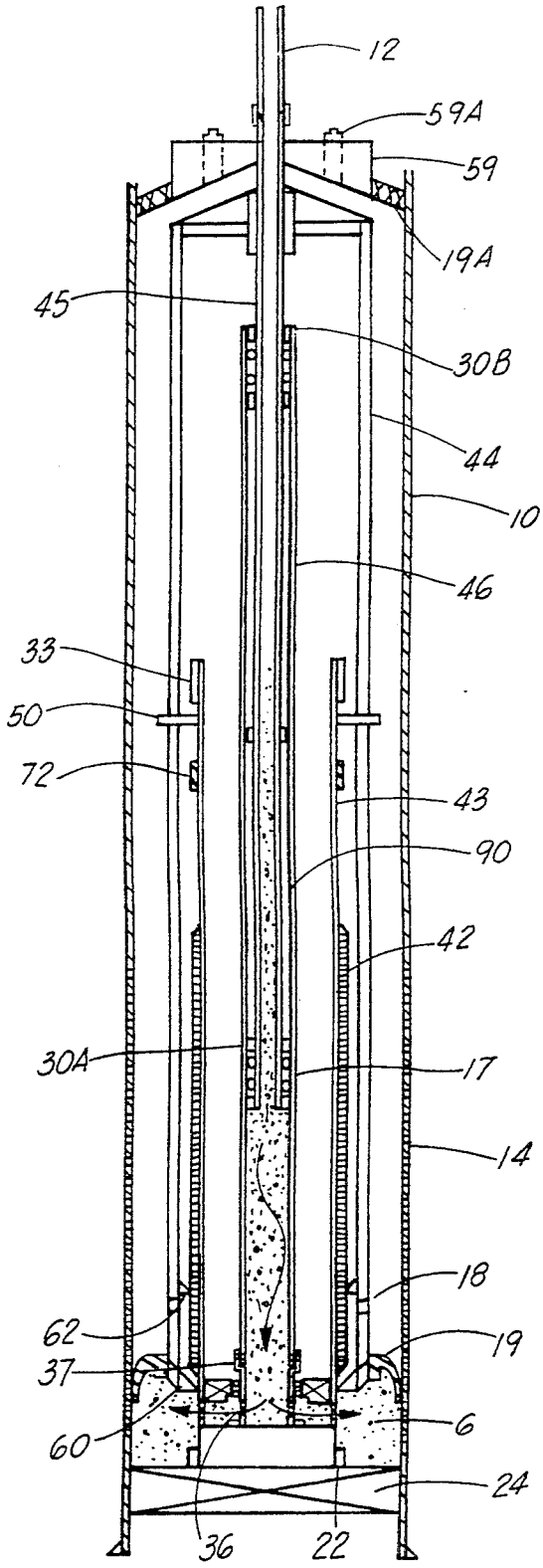
FIG. 4 is a schematic drawing of apparatus for increasing open screen area and exposing additional perforations by moving an enclosing slidable solid sleeve while displacing gravel pack fluid down the inside of a washpipe to the bottom of the screen and through a controllable port to the sealed region of the casing annulus below the sleeve.

In yet another embodiment, shown in FIG. 4, a solid sleeve 44 is outside of screen 42 and large OD wash pipe 90 is inside screen 42. Wash pipe 90 consists of two or more sections. One section with the largest OD 46 is pinned into a sliding sleeve ported sub 36 and is fixed in place during packing operations. The length of wash pipe section 46 is at least equal to the distance from the top of ported sub 36 to above the top of the tell-tail screen 72. Inner wash pipe section 45 moves axially inside wash pipe section 46. Swab cup 17, attached to the end of wash pipe section 45 provides a seal between section 46 and section 45. Stop 30B is provided on the ID at the top of the section 46 and stop 30A is provided on the OD at the bottom of inner wash pipe section 45. Stops 30A and 30B come into contact after the well is gravel packed and allow sliding ported sleeve 36 to be closed by continued upward force on wash pipe 45. Once sliding sleeve 36 is locked closed, additional pull causes shear pin 37 to shear and allows both sections of wash pipe to be removed, along with sleeve 44. Inner wash pipe section 45 is connected to and moves upward with sleeve 44 during gravel packing operations. Wash pipe section 46 is fixed until gravel packing is complete.

The running procedure for apparatus shown in FIG. 4 is similar to the procedure described above for the equipment shown in FIGS. 2A, B and C. After assembly 40 is run into the well and latched into packer 24, enough pull is applied to the work string to shear pin 50. With pin 50 sheared the inner wash pipe section 45, sleeve 44 and attached equipment are free to move axially. Circulation is established once seal 60 is slightly above the bottom of screen 42. Fluid or fluid with gravel flows down work string 12, through wash pipe 90 and through ported sliding sleeve 36 into the annulus between the casing or open hole and screen 42. Swab cup 19 and seal 60 contain the fluid and gravel. Gravel goes into the perforations and filters out of the fluid on screen 42. Fluid goes through the screen and travels between wash pipe section 46 and screen 42. The fluid then crosses over to the casing annulus through port 18 above swab cup 19 and below swab cup 19A, with the orifice of by-pass 59 closed by plug 59A, to maintain pressure on the perforations that are to be gravel packed. The force of squeezing sand will tend to push sleeve 44 upward and indicate to the operator at the surface that it is time to move the sleeve upward. This process will continue until the upper tell tail 72 is covered with gravel. The volume between blank pipe 43 and casing is covered with gravel to create a gravel reserve. Seal assembly 11 and production packer 16 are run into the well, as shown in FIG. 2C, to produce the completed well.

Alternatively, using the equipment such as shown in FIG. 4, port 18 is not used and all fluid is squeezed into the formation.

Wells drilled with short radius turns can be gravel packed in short sections. This would also allow for the placement of packers outside the casing between gravel-packed zones for zone isolation between the gravel packs.

The fluid used for "bottom up" gravel packing as described herein may be any fluid used in conventional gravel packing. Polymers, emulsifiers, foaming agents or other chemicals may be added to increase viscosity of either water-base or oil-base fluids to a sufficient amount to assist in carrying the gravel into the well. The fluid may be lighter than necessary to control the well, allowing for under-balanced gravel packing. The gravel used may be comprised of any gravel-packing material, including lightweight materials known in the art for packing deviated wells.

One advantage of the sleeve diverting apparatus and method shown in FIGS. 2–4 is that the screen will be completely covered and protected while it is being placed at the suitable location in the well. High velocity flow past the screen, which may damage the screen, will not occur in embodiments in which the fluid is conveyed to the distal end of the sleeve through a conduit. Plugging of the screen by debris in the well during this period, which is a problem in many gravel-pack operations, will be avoided. Also, the movement of the sleeve during gravel packing will facilitate the breaking up of any sand bridges that might form during the gravel-packing process. The gravel placement velocity will be greater with the sleeve, since the cross-sectional area for flow will be smaller than that of a conventional gravel pack system. The exterior sleeve can also be used as a washover pipe should the screen fail and removal be desirable. Finally, the cross-over sub allows the screen and perforations to be washed clean or acidized just before gravel packing takes place.

It will be appreciated that while the present invention has been primarily described with regard to the foregoing embodiments, it should be understood that variations and modifications may be made in the embodiments described herein without departing from the broad inventive concept disclosed above or claimed hereafter.

What I claim is:

1. A method of gravel packing a selected interval of a well comprising:

placing a screen in the well and anchoring the screen at a location opposite the selected interval;

placing a sleeve in the well, the sleeve having an upper end and a lower end and being adapted to surround the screen, the sleeve further having attached thereto in proximity to the lower end means for restricting flow in an annulus outside the sleeve and further having attached thereto means for restricting flow between the lower end of the sleeve and the screen;

increasing the area of the screen open for flow therethrough during gravel packing by axial movement of the sleeve.

2. The method of claim 1 wherein the sleeve is comprised of at least two concentric cylinders and the concentric cylinders form a flow conduit along the sleeve.

3. The method of claim 1 wherein the sleeve is a cylinder and a tail pipe adapted to fit inside the screen is further placed inside the screen, the tail pipe being fixed so as to move axially with the sleeve.

4. The method of claim 1 wherein the sleeve is a cylinder and a tail pipe adapted to fit inside the screen is further placed inside the screen, the tail pipe having at least two sections being adapted to slide axially with respect to each other while maintaining a hydraulic seal therebetween, and having an upper end and a lower end, the lower end being removably attached in proximity to the distal end of the screen and the upper end being fixed so as to move axially with the sleeve.

5. The method of claim 1 additionally comprising the step of injecting a fluid into a formation surrounding the selected interval in the well before gravel packing the interval.

6. The method of claim 5 wherein the fluid is predominantly water, brine or acid.

7. The method of claim 5 wherein the fluid is a fracturing fluid and the fluid is injected at a pressure so as to hydraulically fracture the formation surrounding the selected interval in the well before the interval is gravel packed.

8. The method of claim 1, wherein means for fluid cross-over from inside to outside the sleeve is placed above and in proximity to the means for restricting flow outside the sleeve.

9. The method of claim 1 additionally comprising the step of filling the sleeve having the screen enclosed therein with gas before placing the sleeve in the well and floating the sleeve and screen into the well.

10. The method of claim 1 additionally comprising the step of separating the sleeve from the screen and removing the sleeve from the well.

11. The method of claim 1 wherein the area of the screen open for flow during gravel packing is increased while gravel is being pumped.

12. The method of claim 1 additionally comprising the step of simultaneously pumping a fluid down the well in an annulus outside a pipe wherein fluid is being pumped during gravel packing.

13. The method of claim 1 wherein the sleeve has attached thereto conduits to convey fluid to the distal end of the sleeve.

14. The method of claim 1 wherein the screen is anchored by setting a packer in casing or an inflatable packer in open hole below the screen and later fixing the screen to the packer.

15. Apparatus for controlling particle movement into a well comprising:

a screen device;

a sleeve having an upper end and a lower end and adapted to slidably move over the screen device so as to expose increasing area of the screen below the lower end of the sleeve for flow therethrough; and means in proximity to the lower end of the sleeve for restricting flow in an annulus outside the sleeve and means for restricting flow between the lower end of the sleeve and the screen device.

16. The apparatus of claim 15 further comprising a second means attached to the sleeve for restricting flow in the annulus outside the sleeve, the second means being placed at a selected spaced apart location on the sleeve from the means in proximity to the lower end of the sleeve.

17. The apparatus of claim 16 wherein the second means for restricting flow in an annulus outside the sleeve comprises a by-pass having an orifice for flow therethrough.

18. The apparatus of claim 17 additionally having means for controlling the size of the orifice so as to control pressure drop across the second means for restricting flow in the annulus.

19. The apparatus of claim 15 wherein the screen device is a slotted liner or wire-wrapped screen.

20. The apparatus of claim 15 wherein the sleeve has attached thereto means for stopping slidable movement of the sleeve over the screen at a selected location.

* * * * *